United States Patent [19]

Murck et al.

[11] Patent Number: 4,504,052

[45] Date of Patent: Mar. 12, 1985

[54] NOTE RECEPTACLE FOR CURRENCY VALIDATOR

[75] Inventors: Sanford C. Murck, Gates Mills; Anthony H. Dolejs, Bedford Heights, both of Ohio

[73] Assignee: Ardac, Inc., Eastlake, Ohio

[21] Appl. No.: 389,029

[22] Filed: Jun. 16, 1982

[51] Int. Cl.[3] ..... B65H 3/44

[52] U.S. Cl. ..... 271/9; 271/239; 271/240; 209/703; 221/34

[58] Field of Search ..... 271/9, 238, 239, 240, 271/253, 255, 171, 145, 8 R; 209/703, 706, 534; 221/34

[56] References Cited

U.S. PATENT DOCUMENTS

| | | | |
|---|---|---|---|
| 593,003 | 11/1897 | Umhoefer | 221/34 |
| 1,241,897 | 10/1917 | Ananson | 271/9 X |
| 3,947,015 | 3/1976 | Funk | 271/9 |
| 4,424,964 | 1/1984 | Kikuchi | 271/9 |

*Primary Examiner*—Richard A. Schacher

*Attorney, Agent, or Firm*—Oldham, Oldham & Weber Co.

[57] ABSTRACT

A note receptacle for currency validators is presented which is capable of receiving notes of two distinct widths, while offering both such notes to the validator in proper registration for testing. The invention includes two distinct note paths, one beneath the other, which note paths blend together into a final note path which communicates directly to the slot of a currency validator. Side rails are provided along each note path for purposes of alignment and registration.

10 Claims, 4 Drawing Figures

NOTE RECEPTACLE FOR CURRENCY VALIDATOR

TECHNICAL FIELD

The invention herein resides in the art of apparatus for receiving and determining the authenticity of currency, securities, notes, drafts, and the like. More particularly, the invention relates to a receptacle for receiving the currency or documents to be validated, which receptacle is adapted for accommodating papers of various widths. The invention is adapted for implementation with validators which utilize slot acceptors, in which the paper to be validated is inserted in a slot and then transported to or through a testing station. The invention is uniquely adapted for inclusion with a universal type of security validator such as the type disclosed in U.S. patent application Ser. No. 085,394, filed Oct. 16, 1979, for "SECURITY VALIDATOR,", now U.S. Pat. No. 4,348,656 which application has been assigned to Ardac, Inc., of Eastlake, Ohio, the assignee of the instant invention.

BACKGROUND ART

Apparatus for receiving and determining the authenticity of papers such as securities, stocks, bonds, notes, and the like have been known for many years. Typically, such security validators have been of either the tray acceptor type, in which the security is deposited in a tray for transport to a testing station, or the slot acceptor type, in which the paper is inserted into a slot and transported by rollers to the testing station. A universal slot acceptor is taught in the aforementioned U.S. patent application Ser. No. 085,394, for "SECURITY VALIDATOR." Such a device is considered universal in that it utilizes a programmable microprocessor to allow the security validator to be adapted for use in determining the authenticity of a large variety of documents. For example, the microprocessor may be programmed to conduct tests on various denominations of United States currency, while it may be similarly programmed for receiving and testing the authenticity of currencies of various foreign countries. The microprocessor allows the hardware of the security validator to remain substantially fixed, irrespective of the particular currency to be validated. In principle, changes need only be made to the software of the system, defining the tests peculiar to a particular denomination of the currency of the particular country in which the validator is to be used. Accordingly, a single structure has been developed for worldwide use, with software changes being made as a function of the country in which each specific apparatus is to be placed.

Applicants have found that, throughout the world, while currencies are of somewhat standard sizes, currency width does vary from country to country, and from denomination to denomination within a given country. Utilizing a slot of fixed width to receive the note requires that the slot be of sufficient width to accommodate the widest note which might possibly be introduced to the validator. In such case, the slot must be of sufficient width that when narrower pieces of currency are introduced, there is a significant likelihood that the note will be received at the test station out of registry, or misaligned, with the testing circuitry, lamps, reticles, sensors, and the like. The result is erroneous rejections of valid currency. The validator then gives the appearance of being inaccurate and unreliable when, in fact, the problem is merely the result of misalignment of the offered paper with the test apparatus.

To overcome the problem of misregistration, the validator of the aforementioned copending patent application might be provided with slots of widths determined by the widths of the various currency to be introduced to the particular apparatus. However, such provision defeats the concept of a universal slot acceptor and validator, since substantial hardware changes would be required as a function of system application. As a result, the benefits sought to be obtained by a universal validator, would be defeated.

DISCLOSURE OF INVENTION

In light of the foregoing, a first aspect of the invention is the provision of a note receptacle for a currency validator which includes a plurality of tracks of different widths feeding to the slot of the acceptor.

Another aspect of the invention is the provision of a note receptacle for a currency validator wherein plural tracks are fed to a single slot, which tracks have a common centerline for properly receiving a paper and presenting it to a test station.

Still another aspect of the invention is the provision of a note receptacle for a currency validator which is readily adaptable for inclusion with presently existing slot acceptors.

Yet an additional aspect of the invention is the provision of a note receptacle for a currency validator which is simplistic in concept and construction, while being accurate, reliable, and durable in operation.

The foregoing and other aspects of the invention which will become apparent as the detailed description proceeds are achieved by a note receptacle for a currency validator, comprising: top and bottom plates having first ends in spaced-apart, parallel relationship with each other, and defining a passageway therebetween; and side rails connected to said top and bottom plates along lateral edges thereof, said side rails defining plural widths of said passageway at second ends of said top and bottom plates.

BRIEF DESCRIPTION OF DRAWINGS

For a complete understanding of the objects, techniques, and structure of the invention, reference should be had to the following detailed description and accompanying drawings, wherein.

BEST MODE FOR CARRYING OUT THE INVENTION

Figure 1:
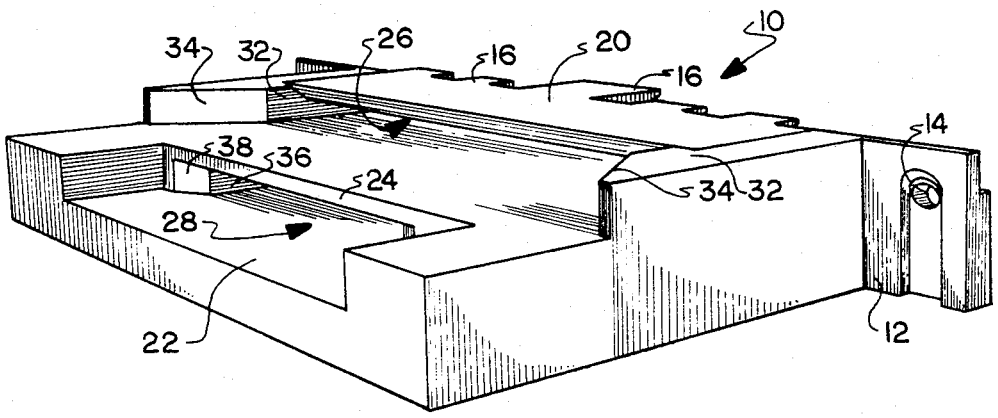
FIG. 1 is a perspective view of a first embodiment of the note receptacle of the invention.
Figure 2:
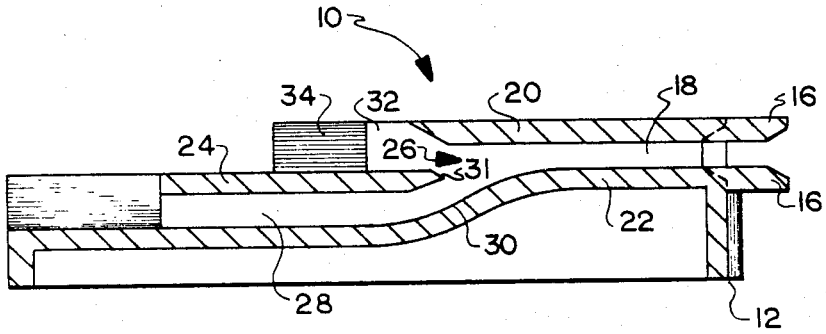
FIG. 2 is a cross-sectional view of the note receptacle of FIG. 1.

Referring now to the drawings and more particularly FIGS. 1 and 2, it can be seen that a note receptacle according to the invention is designated generally by the numeral 10. A back plate 12 is provided with holes 14 at each end thereof for allowing the receptacle 10 to be affixed to a slot acceptor-type of currency validator, the receptacle 10 being placed over the slot and in communication therewith.

Connected to and extending from the back plate 12 is a top plate 20 and a bottom plate 22, the same defining a passage 18 therebetween. Plates 20,22 may be characterized by tines or fingers 16 extending from the back edges thereof. The tines 16 are received within the slot of the slot acceptor and are provided for the purpose of mating with complementary fingers or tines within the slot to obtain secured registered placement of the receptacle 10 with respect to the slot of the validator.

In the embodiment of FIGS. 1 and 2, there is provided an intermediate plate 24 between the plates 20,22. As best shown in FIG. 2, the passage 26 between the plates 20,24 is a straight passage communicating directly in line with the passage 18. The passage 28, defined between the plates 22,24, inclines upwardly to communication with the passage 18. For this reason, the intermediate plate 24 terminates at the inclined portion of the plate 22 and is beveled or tapered as at 30 on the same angle as the incline of the plate 22 at that area such that the passage 28 is of uniform height. The top back edge portion of the plate 24 is also preferably chamferred, as at 31, such that papers being returned from the validator slot will easily ride up over and be returned along the plate 24 without fear of catching bent or turned edges or the like. It will be appreciated that, irrespective of the path taken by the paper for entry to the slot of the validator, returns will be made along the straight and widest path 26.

Side rails 32 define the width of the upper passage 26 between the plates 20,24. The side rails 32 may be provided with leading edges which are tapered inwardly as at 34 to facilitate entry and positioning of the currency offered through the passage 26 along the top of the intermediate plate 24. In similar fashion, side rails 36 are provided in interconnection between the bottom plate 22 and intermediate plate 24 to define the width of the passage 28. Again, tapered leading edges 38 are provided to facilitate reception and positioning of the paper offered to the validator.

As will be seen from FIG. 1, the spacing of the side rails 32 is wider than that of the side rails 36, such that the passage 26 is wider than the passage 28. Typically, the passage 18 would be of the same width as the passage 26. Accordingly, denominations of a first width may be offered through the passage 26, while denominations of a narrower width may be tendered to the passage 28. In either event, the paper tendered is passed through the passage 18 and to the slot acceptor in proper registration for receipt at the test station.

Figure 3:
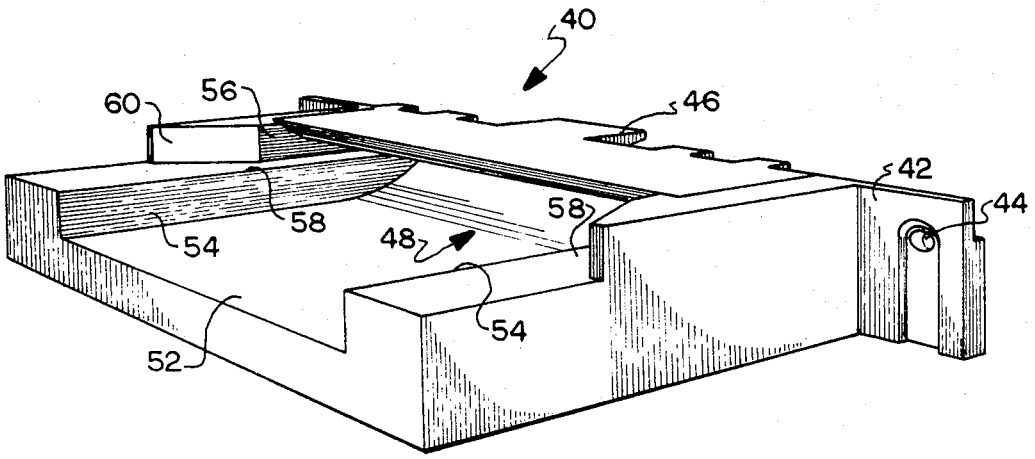
FIG. 3 is a perspective view of a note receptacle comprising a second embodiment of the invention.
Figure 4:
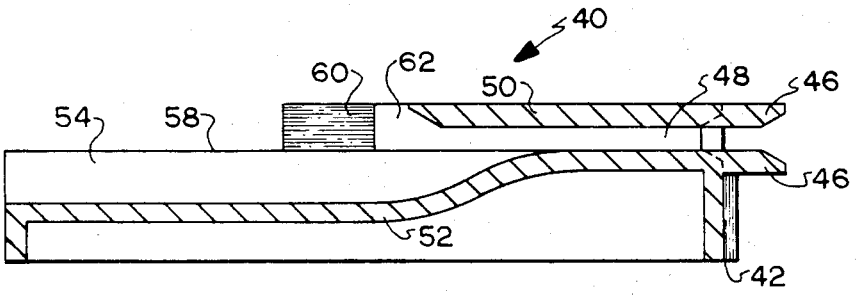
FIG. 4 is a sectional view of the note receptacle of FIG. 3.

With reference now to FIGS. 3 and 4, a second embodiment of the invention may be seen as designated generally by the numeral 40. Again, the note receptacle 40 includes a back plate 42 having holes 44 therein for securing engagement with the slot acceptor. Tines 46 are also provided for proper secured alignment between the receptacle 40 and the validator slot. A passage 48 is defined between an upper plate 50 and a lower plate 52, the lower plate 52 having an arcuate inclined portion beneath the front edge of the top plate 50. Side rails 54 define the width of the bottom plate 52, which plate is adapted for receiving papers of a narrow width. In similar fashion, side rails 56 are provided in engagement with the top plate 50 for defining a passage for wider notes or pieces of currency. The top portion 58 of the side rails 54 helps to define a track for such wider pieces of currency, the track 58 leading directly into the top surface of the lower plate 52, as best illustrated in FIG. 4. Again, the leading edge of the side rails 56 may be tapered as at 60 to facilitate insertion and reception of the currency being tendered.

It will thus be apparent from FIGS. 3 and 4 that a narrow note may be placed between the side rails 54, moved upwardly across the inclined portion of the bottom plate 52, and through the passage 48 for registered reception by the slot acceptor. In similar fashion, a wider note may be placed on the tracks 58, between the side rails 56 and tendered to the passage 48 for registered receipt by the slot acceptor.

It should now be apparent that the receptacles 10,40 provide means for adapting a universal slot acceptor to receive currency and the like of various widths by simple application of the receptacle adapters disclosed herein. With the main structure of the universal slot acceptor remaining constant, the acceptor may be adapted for use in virtually any country by the implementation of software programming and the application of an appropriate receptacle adapter 10,40.

Thus it can be seen that the objects of the invention have been satisfied by the structure presented hereinabove. The invention allows the presentation of at least two distinct widths of notes or pieces of currency to a slot acceptor-type of currency validator, with both widths being received by the validator in fixed, predetermined registration for testing. While only the best mode and preferred embodiments of the invention have been presented and described in detail, it will be understood that the invention is not limited thereto or thereby. Accordingly, for an appreciation of the true scope and breadth of the invention, reference should be had to the following claims.

What is claimed is:

1. A note receptacle for a currency validator, comprising:

top and bottom plates having first end portions in spaced-apart, parallel relationship with each other, and defining a passageway therebetween; and side rails connected to said top and bottom plates along lateral edges thereof, said side rails defining plural widths of said passageway at second end portions of said top and bottom plates.

2. The note receptacle as recited in claim 1 wherein said top plate is shorter than said bottom plate.

3. The note receptacle as recited in claim 1 wherein said second end portion of said bottom plate is below said first end portion of said bottom plate, and wherein said bottom plate includes an inclined portion therebetween.

4. The note receptacle as recited in claim 3 which includes two sets of side rails, a first set extending downwardly from said top plate, and a second set extending upwardly from said bottom plate.

5. The note receptacle according to claim 4 wherein said first set of side rails is spaced apart differently from said second set of side rails.

6. The note receptacle according to claim 5 wherein said first set of side rails is wider than said second set, said first set being received upon said second set, and thereby defining a track.

7. The note receptacle according to claim 5 which further includes an intermediate plate, interposed between said second end portions of said first and second plates, and interconnecting said first and second sets of side rails.

8. The note receptacle according to claim 7 wherein said second end portion of said top plate is positioned above said inclined portion of said bottom plate at a point where said intermediate plate terminates.

9. The note receptacle according to claim 5 wherein said second set of side rails terminates short of said first set of side rails, said second set of side rails terminating at said inclined portion.

10. The note receptacle according to claim 1 wherein said first end portions of said top and bottom plates include tines extending therefrom.

* * * * *